United States Patent [19]

Koch et al.

[11] Patent Number: 4,817,241

[45] Date of Patent: Apr. 4, 1989

[54] HINGE, IN PARTICULAR FOR FURNITURE

[75] Inventors: Gerhard Koch, Nagold; Roland Hölzle, Haiterbach, both of Fed. Rep. of Germany

[73] Assignee: Kaefele, KG, Fed. Rep. of Germany

[21] Appl. No.: 137,412

[22] Filed: Dec. 23, 1987

Related U.S. Application Data

[63] Continuation-in-part of Ser. No. 859,082, May 2, 1986, abandoned.

[51] Int. Cl.[4] ..... E05D 7/04; E05D 15/00

[52] U.S. Cl. ..... 16/238; 16/245; 16/369; 16/370; 16/372

[58] Field of Search ..... 16/238, 243, 245, 369, 16/370, 372

[56] References Cited

U.S. PATENT DOCUMENTS

| | | | |
|---|---|---|---|
| 542,250 | 7/1895 | Gilman | 16/369 |
| 1,030,936 | 7/1912 | Soss | 16/369 |
| 1,697,801 | 1/1929 | Walter | 16/369 |
| 2,021,702 | 11/1935 | Soss | 16/369 |
| 2,135,280 | 11/1938 | Erickson | 16/369 |
| 4,293,976 | 10/1981 | Pittasch et al. | 16/245 |

FOREIGN PATENT DOCUMENTS

| | | | |
|---|---|---|---|
| 2647776 | 4/1978 | Fed. Rep. of Germany | 16/245 |
| 2648095 | 4/1978 | Fed. Rep. of Germany | 16/238 |
| 3316048 | 11/1984 | Fed. Rep. of Germany | 16/238 |
| 1404141 | 5/1965 | France | 16/369 |

*Primary Examiner*—Fred Silverberg
*Assistant Examiner*—Edward A. Brown
*Attorney, Agent, or Firm*—McGlew & Tuttle

[57] ABSTRACT

To be able to mount a mitered door to a mitered wall and open it as wide as possible, and for keeping the miter joint as tight as possible, a hinge for the door comprises two base parts or inner and outer housings which are likewise mitered, making close contact with each other in the "closed position" of the hinge and being coordinated with the miter plane of the piece of furniture or the like. The two base parts are interconnected by long brackets and short brackets, the long brackets forming crosses and being connected by a pin. The inner housing is adjustable relative to the outer housing in the longitudinal direction and in the transverse direction, each by given amounts. Each adjustment is made via a turnable pinion acting upon a rack of a first intermediate member. The adjustment of the inner housing relative to the outer housing is achieved via the intermediate members, each of which is retained in one direction.

29 Claims, 6 Drawing Sheets

HINGE, IN PARTICULAR FOR FURNITURE

RELATED CASE INFORMATION

This case is a continuation-in-part of application Ser. No. 859,082 filed May 2, 1986, now abandoned.

FIELD AND BACKGROUND OF THE INVENTION

The present invention relates to a hinge for hinging a door or the like, in particular the door of a piece of furniture, to a wall member. The hinge comprises two base parts interconnected by brackets. The brackets assume the task of drag links. Their size and the arrangement of their bearing pins determine the kinematics when opening the door. In the case of a furniture door, the wall member is usually a sidewall of the piece of furniture. But it could also be a corresponding frame which is closed by the door or also by two doors, such as doors opening in opposite directions.

SUMMARY OF THE INVENTION

It is an object of the present invention to provide a hinge of the kind mentioned above, which is very rugged and makes stable hinging of the door possible while requiring little space and affording easy installation.

Accordingly, a further object of the present invention is to provide a hinge of the kind mentioned above, which is very rugged and makes stable hinging of a door possible while requiring little space and affording easy installation.

Accordingly, a further object of the present invention is to provide a hinge for hinging a door to a wall member, comprising a first base part for connection to the door, a second base part for connection to the wall member, a first long lever or bracket pivotally connected at one of its ends to the first base part, a first short lever or bracket pivotably mounted to the first base part at a location spaced from the first long lever or bracket, a second long and second short lever pivotably mounted to the second bracket, the first and second long levers crossing each other being pivotably mounted to each other near their centers and each long lever of one bracket being pivotably connected to the short lever of the other bracket.

As a rule, two such hinges will be used, for high doors possibly even more. In addition, it is of course better for stability reasons to use more than one long and one short lever or bracket per base part. The first base part is fastened to the door in a known manner and the second one to the wall member or to a frame or the like. The shape of the base part depends, on the one hand, on the specified kinematics when opening the door, and on the other hand, the requirement of easy assembly with tools available in the relevant facilities, such as furniture factories, must be taken into account.

One particular advantage of the hinge according to the invention is that it can also be installed, and even in a preferred manner, when a mitered door adjoins a likewise mitered wall member. Especially in the field of furniture manufacturing preference is given to the beveled joint of doors versus a butt joint formerly in common use because beveled joints assure better dust tightness.

A further development of the invention provides that the active length of each long bracket be approximately twice that of the short one. This contributes to being able to open a mitered door relatively wide with this hinge, e.g. about 130° to 140°, relative to its closed position.

One end of each long bracket is connected to its base part and the other end to the short bracket of the other base part.

In between is the articulation point between the crossed long brackets. These three joints of each long bracket may be located on a straight line or they have include an angle. One particularly preferred embodiment of the invention consists in that the articulation points of the long brackets form an angle of about 160°. This, too, has a particularly favorable effect on the kinematics of opening and closing the door.

It is suggested in another embodiment of the invention that the long bracket consists of a shorter and a longer lever arm whose length ratio is about 1 to 1.15, each shorter lever arm being associated with the short bracket. The "central" articulation point of the long brackets thus lies nearly between the two outer articulation points. Small length differences of the two lever arms are advantageous with respect to the desired opening and closing behavior, i.e. the overall kinematics. If, for example, the longer effective lever arm is 22 mm long, the associated length of the shorter lever arm is about 19.2 mm.

Another preferred embodiment of the invention is characterized in that the linkage points of each base part to the connecting pin of the long brackets and the articulation point of its short bracket with the associated long bracket mark the corners of a parallelogram in any position of the hinge. Since every hinge has two base parts, there are also two parallelograms with one common corner, namely the connecting pin of the mutually crossing long brackets. In a starting or closed position of the hinge, the two base parts are located close to each other and the parallelograms are relatively stretched out. During the course of the opening motion, the parallelograms approach more and more the form of a square which, due to the lever ratios mentioned, is not reached exactly, however. As the door is opened wider, the parallelograms are folded flat, resuming a stretched shape at the end again. But it is transverse to the stretched out form assumed in the beginning. At the end of the opening motion the two flat parallelograms are approximately in continuation of each other. The two base parts are now at a maximum distance from each other.

One special variant of the invention consists in that one base part is designed as an inner housing forming the other base part so as to be movable in two mutually perpendicular axes. The outer housing is joined firmly to the door and the other base part firmly to the wall or the like. Each inner housing can now be moved relative to its outer housing in lengthwise and crosswise directions by a given amount. The door can be aligned with the wall very exactly in this manner, which is necessary when the parts are mitered, primarily for visual reasons. Yet, no particularly high accuracy requirements need be met by the outer housing fastening. Starting from a central position, the adjusting motion, e.g. for a furniture hinge, may be e.g. 2 mm or even a little more, to each side and in each direction.

In this connection, it is of particular advantage for the outer housing to be designed as a single bore housing, essentially consisting of a potshaped mounting part and a mounting plate attached to the pot rim, the mounting part being beveled 45° and the beveled edges of the two mounting parts contacting each other in the "closed position", or at least being roughly parallel to each other. Single bore fittings are known per se. Consequently, the tools required, such as milling cutters or special drills, are usually available to the user or at least easy to get. While the mounting part is recessed into the door on the one hand or into the wall on the other, the mounting plate lies flat against the inside surface of the door or wall. But it is also quite possible to recess the mounting plates somewhat also so that their outside surfaces are flush with the inside surface of the door or wall. In addition, one can provide on the mounting plate, in particular to both sides of the mounting part, at least one fastening hole to put a fastening screw or the like through. The preferred bevelling of the mounting parts by 45° makes it possible to align this hinge with the 45° miter plane. The 45° bevelled edge of the mounting part is then flush with the miter surface of the door on the one hand and of the wall on the other. In the latter case, the 45° edges are in mutual contact when the door is closed. Bevelling is expediently done so that, in the area of the pot bottom, there remains a short, but complete cylinder of the outer housing, i.e. the bevel does not go directly as far as the bottom of the outer housing. This causes the outer housing to be completely enclosed by the door or wall material in the area of its bottom.

Another preferred embodiment is characterized by the use of turning members, mounted to the inner housing, for the lengthwise and crosswise adjustment respectively, their turning motion being translatable into a motion of the inner housing relative to the outer housing via intermediate members. The intermediate member for longitudinal adjustment is mounted so as to be movable in the transverse direction only and that for transverse adjustment in the longitudinal direction only on the outer housing. Of course, such a lengthwise and crosswise adjustability is provided on each one of the two base parts. It is very sensitive, and if the turning member is designed appropriately, can be operated with conventional tools, e.g. a screwdriver. Due to this sensitive adjustability, the door can be aligned quickly and accurately to a frame or a carcass opening or a wall to which it is hinged.

The various features of novelty which characterize the invention are pointed with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

BRIEF DESCRIPTION OF THE PREFERRED EMBODIMENT

Figure 1:
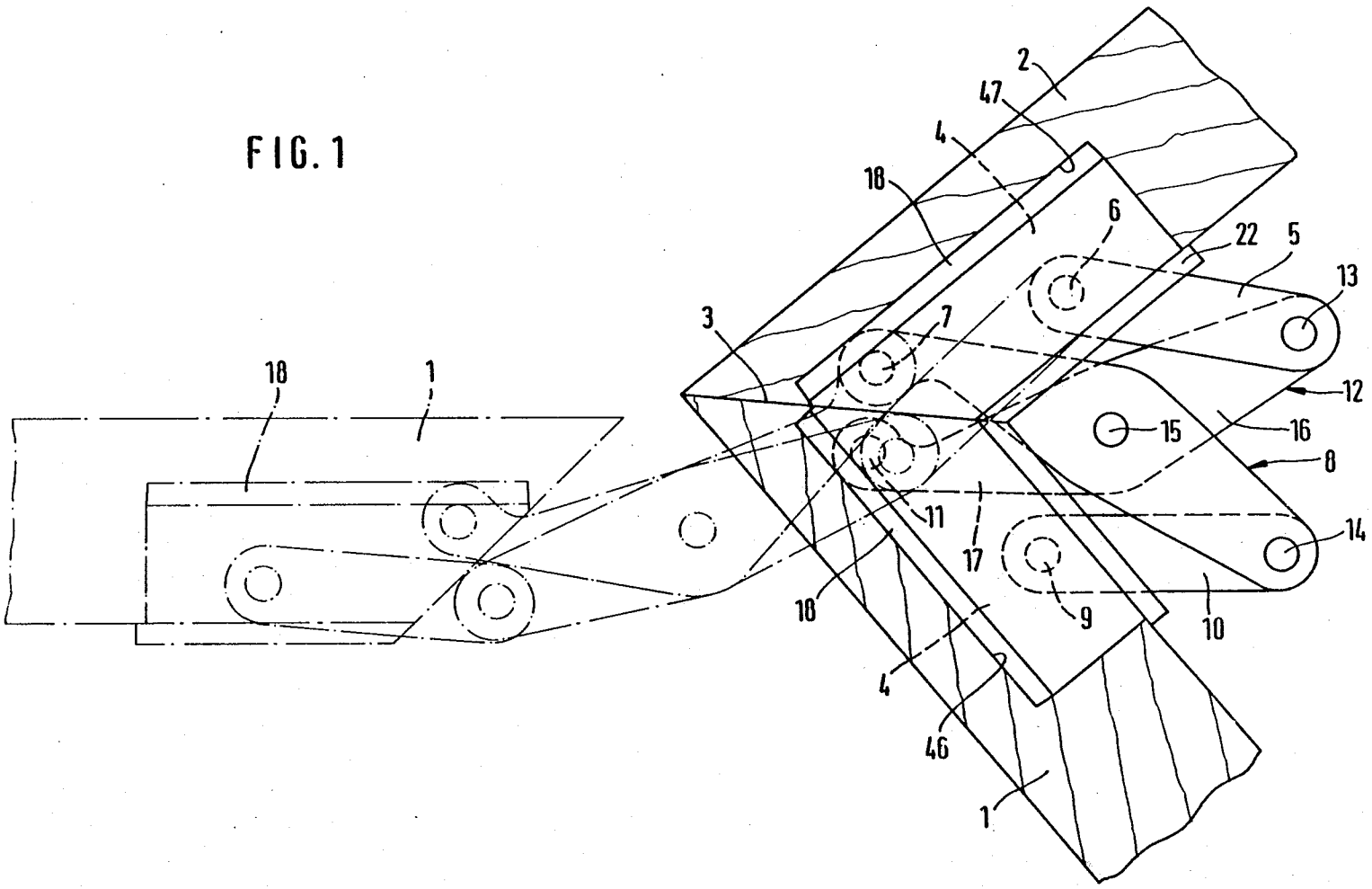
FIG. 1 is a top view of the installed hinge with both of its end positions shown.

The hinge according to the invention and shown in FIG. 1 serves to hinge a door 1 or the like to a wall member 2, such as the carcass of a piece of furniture. Both parts may be mitered, and they are in preferred manner. The miter plane is marked 3. Hinged to each identical base part 4 is at least one short and one long lever or bracket. It is preferred to have three short and three long brackets per base part. The short brackets 5 on the wall base part 4 are pivoted about a first pin 6. A second pin 7 serves to mount the long brackets 8 on the wall side. A third pin 9 serves to hinge the short bracket 10 to the door base part 4. At the latter, the long brackets 12 of the door base part 4 are pivoted about a fourth pin 11. A fifth pin 13 connects the brackets 5 and 12, while a sixth pin 14 serves to connect the brackets 10 and 8. Finally, there is yet a seventh pin 15 which interconnects the central areas of all long brackets.

All pins are parallel to each other and perpendicular to the drawing plane in FIG. 1. It may further be seen from the figure that the pins 6, 7, 15 and 13 on the one hand and the pins 9, 11, 15 and 14 on the other, mark the corners of a parallelogram. The dash-dotted lines in FIG. 1 show an addition that, in the other end position of the hinge also, the said pins mark the corners of two interconnected parallelograms.

One of the prerequisites therefore is the mentioned connection of the long brackets in their central area and the fact that each long bracket 8, 12 is approximately twice as long as the short brackets 5, 10. In addition, the spacing of the pins 6 and 7 on the base part 4, and the spacing of the pins 9 and 11 on the other base part 4 corresponds approximately to the spacing of the pins 13, 15 and 14, 15 respectively. Each long bracket consists of a shorter lever arm 16 and a longer lever arm 17, the shorter lever arm being assigned to the short bracket 5 or 10, respectively. The length ratio of the lever arms 16 and 17 is preferably about 1:1.15. The articulation points 11, 15, 13 and 7, 15, 14 respectively, of the long brackets 8 and 11 are not in a straight line but form an angle of preferably about 160°.

The base part 4 is designed as inner housing 25 and is adjustable in an outer housing 18 in two axes 19, 20 (FIG. 3) that are perpendicular to each other. The outer housing 18 is designed as a single bore housing. It consists essentially of a pot-shaped mounting part 21 and a mounting plate 22 attached to the pot rim. It is evident from FIG. 3, for example, that the width 23 of the mounting plate 22 covers about half the diameter of the mounting part 21, the other half of the mounting part being bevelled, as may be seen from FIG. 1 of the drawing. In the installed state, the bevelled edge 24 of the mounting part 21 lies in the miter plane 3.

Figures 4, 5, 6:
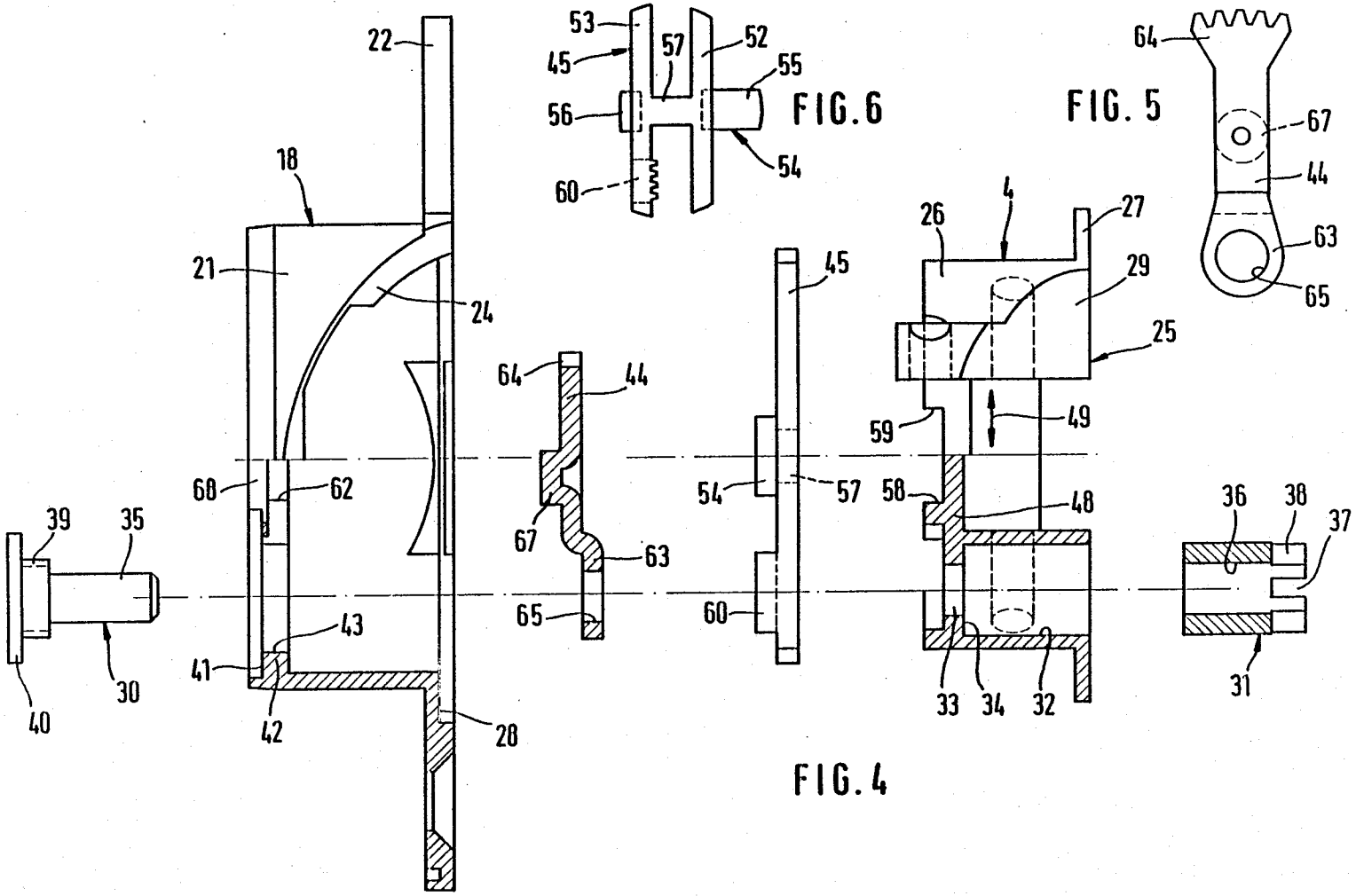
FIG. 4 is an exploded view of the essential parts of one hinge half without the brackets in side view and partly sectioned in the longitudinal direction.
FIG. 5 is a top view of the intermediate member for the longitudinal adjustment.
FIG. 6 is a top view of the intermediate member for the transverse adjustment, but shown half the size of FIG. 4.
Figures 7, 8:
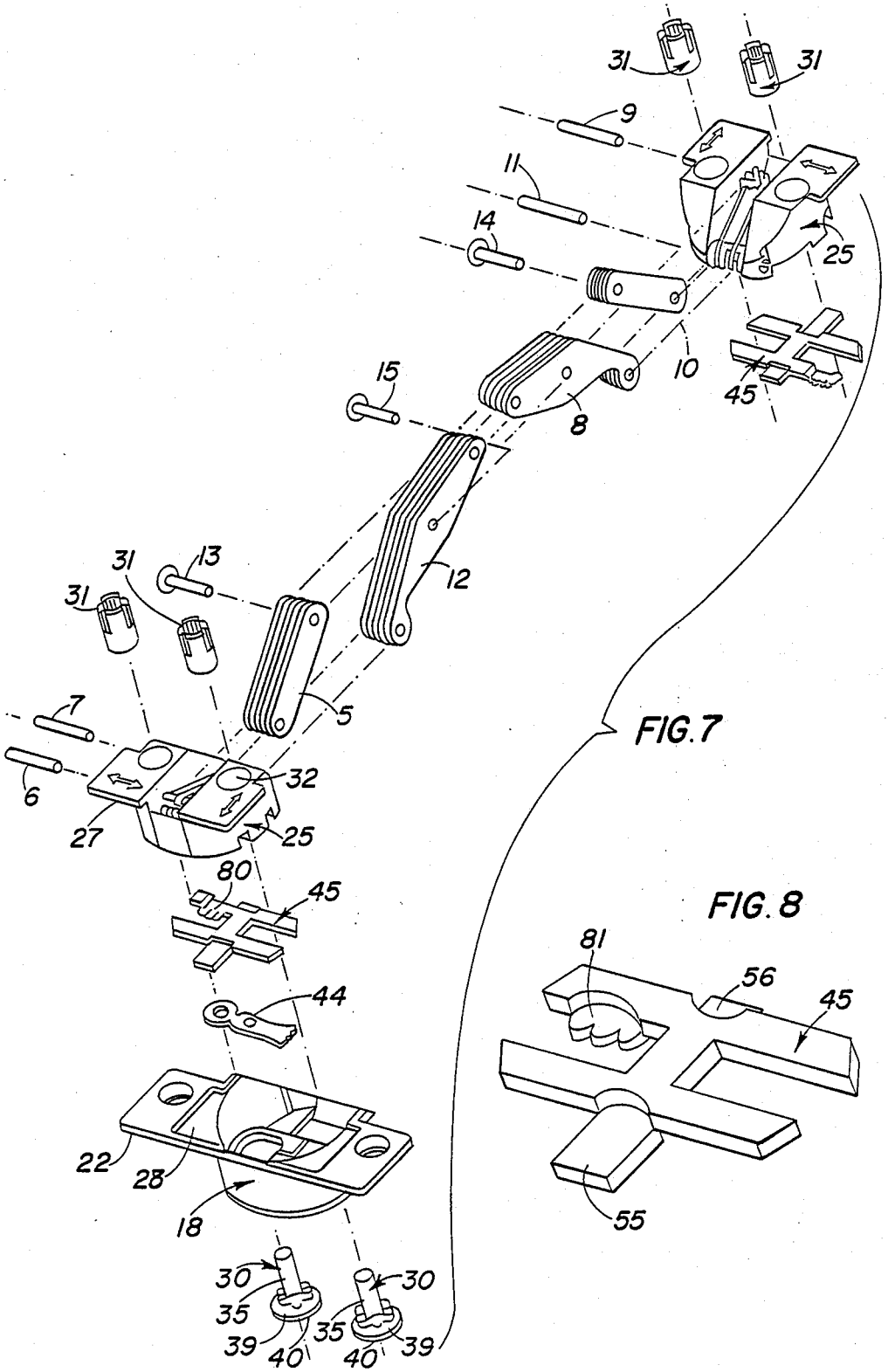
FIG. 7 is an exploded perspective view showing the features of a hinge half, the brackets and a portion of the second hinge half.
FIG. 8 is a perspective view showing an alternative construction of an intermediate member for transverse adjustment.
Figure 9:
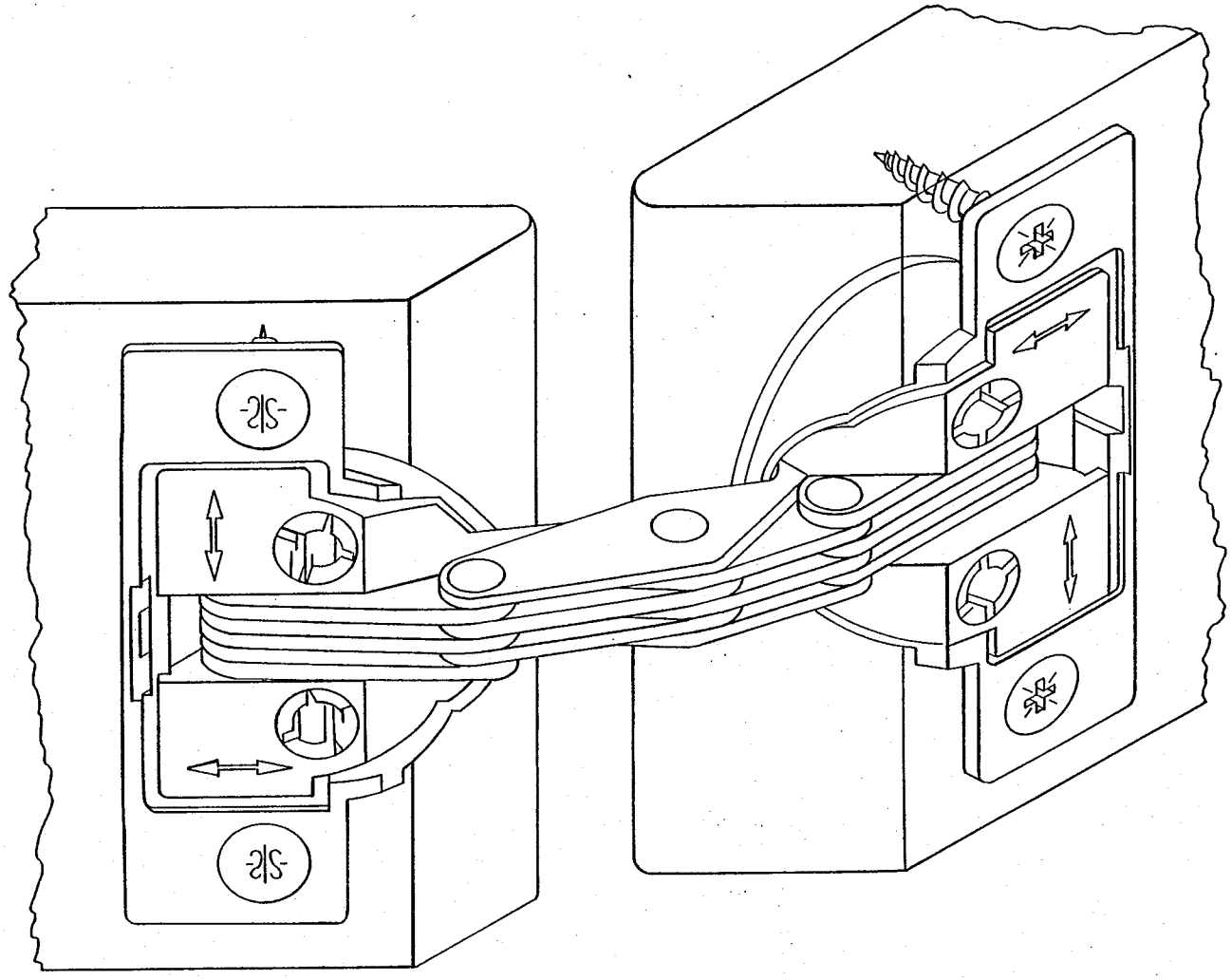
FIG. 9 is a perspective view of the hinge shown assembled to both the door and the wall member.

It may be seen from FIGS. 4 and 7 that the inner housing 25 or the base part 4, respectively, are of a shape essentially corresponding to that of the outer housing 18, a mounting part 26 of the inner housing 25 engaging the mounting part 21 of the outer housing 18. The mounting part 26 of the inner housing 25 also has a 45° bevel, the bevelled surfaces 29 being flush with the arched, oblique edge 24 of the mounting part 21 of the outer housing 18 in the installed condition.

The inner housing 25 also has a mounting plate 27 which is smaller than the mounting plate 22 of the outer housing 18, however. It is evident from FIG. 3 that the mounting plate 27 is recessed in a depression 28 of the mounting plate 22, the dimensions of the depression and of the mounting plate 27 being such that a relative motion in the sense of the arrows 19 and 20 by the respectively intended maximum amount is possible. Both plates are preferably approximately flush on the outside. The outer housing and the inner housing are interconnected by a combined connecting element 30 and tubular actuating member 31. The tubular actuating member 31 is located, in the assembled state of the hinge, in the expanded part 32 of a bearing hole 33, supporting itself against a shoulder 34.

Figure 3:
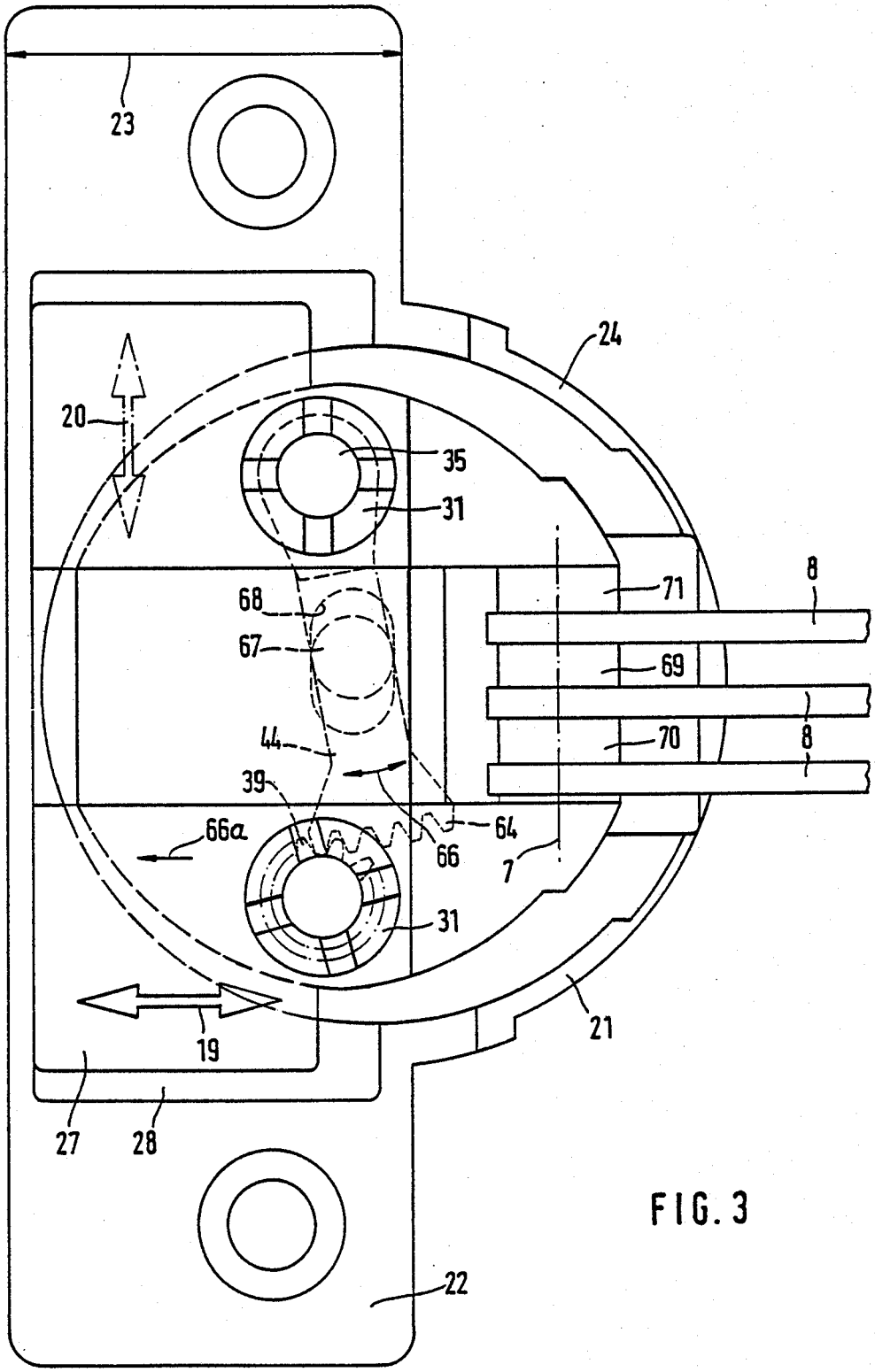
FIG. 3 is a view corresponding to that of FIG. 2 with the lengthwise adjustment shown.

The element 30 is at the same time a turning member for the adjusting motion in the sense of the double arrow 19 (FIG. 3). Its bolt-shaped part forms a bearing shaft 35 which is press-fitted in the hole 36 of the actuating member 31. The latter has two actuating slots 37 and 38 arranged crosswise for the application of a screwdriver. Due to the press fit the bearing shaft 35 can be turned via the tubular actuating member 31, leading to the adjusting motion in the sense of the double arrow 19 in a manner yet to be described below.

The connecting and/or turning member 30 supports a pinion 39 and directly adjacent thereto, or at a small distance therefrom, a disc-shaped head 40. The latter is in a depression 41 on the outside of the pot bottom 42 of the pot-shaped mounting part 21 of the outer housing 18. Each depression 41 is essentially of rectangular shape with rounded corners and, like the breakthrough 43, is dimensioned so that the adjusting motions 19 and 20 (FIG. 3) can take place without interference.

The rotary motion of the actuating member 31 and, hence, of the pinion 39 is transferred to the inner housing 25 via an intermediate member 44 with respect to the lengthwise motion 19 and via an intermediate member 45 with respect to the crosswise motion 20, which means that the inner housing carries out either a lengthwise or a crosswise motion relative to the outer housing 18 which is stationarily retained in a recess 46 or 47 of the door 1 or wall 2, when the respective actuating member 31 is turned.

The first intermediate member 45 for the transverse motion 20 is designed as a slider which is movable back and forth on the outside of the pot bottom 48 of the inner housing 25 in the sense of the double arrow 49 and whose longitudinal H-bars 52, 53 are movably guided in longitudinal guideways 51, 51' on the outside of the pot bottom of the inner housing 25, these guideways being recessed so deep that only the attachment 54 resembling a sliding block projects beyond the outside of the pot bottom. The attachment 54 consists of the two parts 55 and 56 which form a gap for the second intermediate member 44 to penetrate. The motion of the H cross web 57 in the sense of arrow 49 is limited by the two parallel stop edges 58 and 59 provided on the inner housing.

A rack 60 is provided, in particular formed, in the end zone of one of the longitudinal H bars, in the embodiment per FIG. 6 on the longitudinal H bars 53. The rack is in the same plane as the attachment 54 resembling a sliding block. Its teeth mesh with those of the pinion 39 of its associated turning member 30 (at the top in FIG. 2). It is easy to see that a rotation of the pinion 39 leads, by means of its co-rotating tubular actuating member 31, to a movement of the rack in the sense of arrow 61 or, when turned in the opposite direction, in the sense opposite to arrow 61, thus moving the inner housing 25 downwardly (FIG. 2) or upwardly relative to the outer housing 18.

Figure 2:
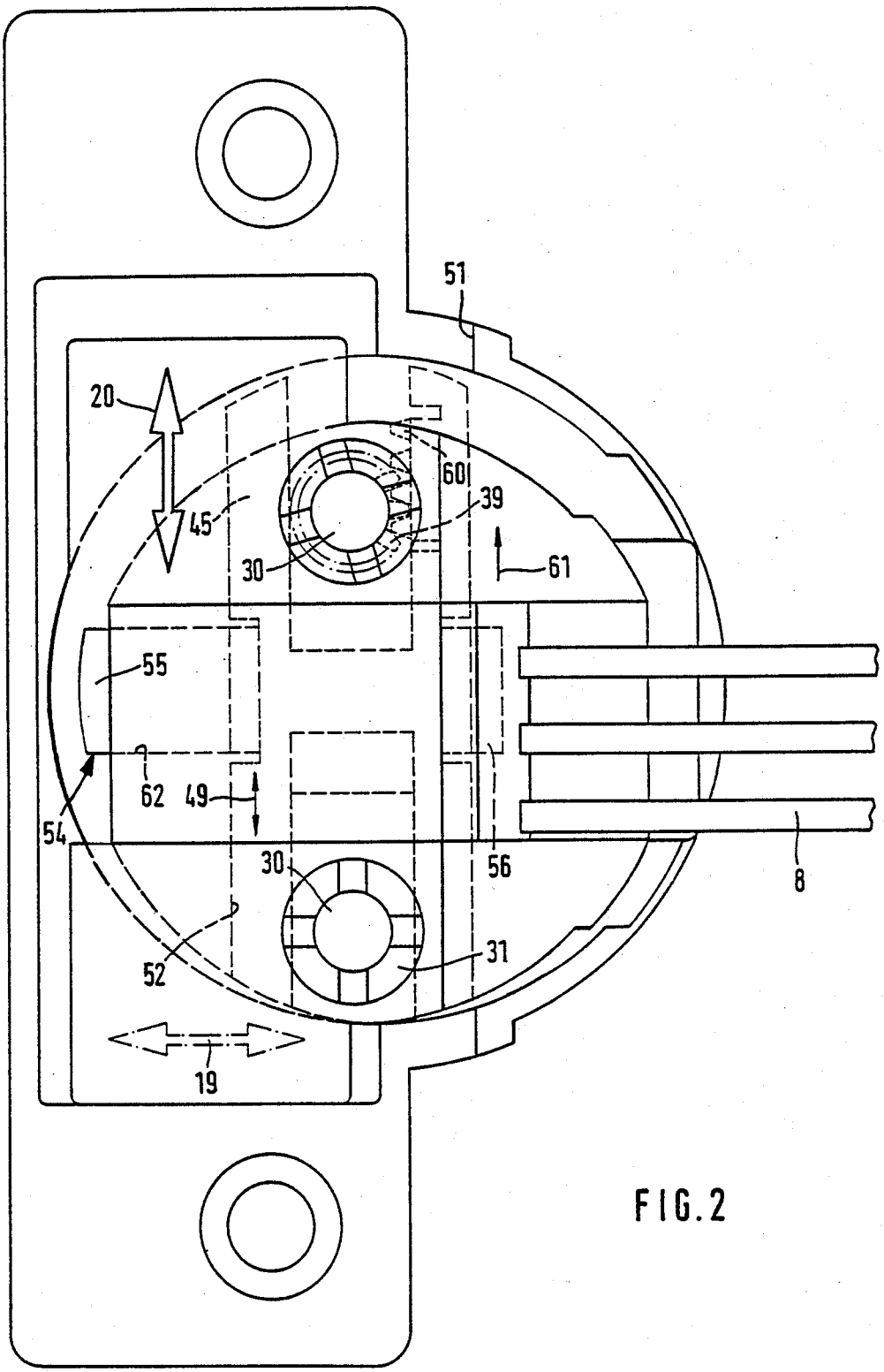
FIG. 2 is a top view of the side of the one hinge and visible after its installation on a larger scale, showing the transverse adjustment.

In FIG. 2, the lower end position is shown. The first intermediate member 45 must be retained in the outer housing 18 so as to be immovable in the sense of the double arrow 19. It is movable only in the direction of the double arrow 20 in a longitudinal guiding means 62 of the outer housing 18, located on the inside of the pot bottom 42.

The second intermediate member 44 is of elongated shape (FIG. 5). At its one end is an offset bearing lug 63 and at its other end a gear segment 64. The bearing hole 65 is penetrated by the bearing shaft 35 of the connecting element or turning member 30. Accordingly, the second intermediate member 44 is pivotable about its bearing shaft 35 in the sense of the double arrow 66 (FIG. 3).

The teeth of the gear segment 64 mesh with those of the pinion 39 of the associated turning member 30. Rotating the tubular member 31 in the one direction of rotation causes the second intermediate member 44 to pivot in arrow direction **66*a* and a rotation in the opposite direction causes the second intermediate member to pivot in the direction opposite to arrow 66*a*, as indicated in FIG. 3, by the corresponding end position. What is achieved thereby is the lengthwise adjustment of the inner housing 25 relative to the outer housing 18. However, this is possible only because a sliding pin 67 engaging slot-shaped transverse guiding means 68 of the outer housing 18 projects transversely to the plane of the second intermediate member 44 approximately in the central area. This guiding means is also located in the pot bottom 42 between the two breakthroughs 43 for the turning shafts 30. The spacing of the two attachment parts 55 and 56 limits the angle by which the intermediate member 44 can pivot and, hence, the magnitude of the adjusting motion in the sense of the double arrow 19. Due to the offset of the end of the second intermediate member 44 on the bearing side, the bearing lug 63 lies in the same plane as the longitudinal H bars 52 and 53, or, expressed more accurately, between the two longitudinal H bars. Most of the second intermediate member 4 including the gear segment 64 lies in the plane of the attachment 54 resembling a sliding block or protrudes between its two parts From FIG. 4 of the drawings, it is evident that portions 54, 56 and rack 60 lie in a different plane than that of the essentially H-shaped intermediate elements 52, 53, and 57. Further, in FIG. 4, it can be seen that the second intermediary element 44 has an offset bearing eye 63, that is, disposed parallel to the plane of longitudinal H-bars 52 and 53. By this construction, if the second intermediate element 44 rests against the first intermediate element 45, the bearing eye 63 is in the plane of H-bars 52 and 53 of the H-shaped first intermediary element 45, while the rack 60 is in the plane of the second intermediary element 44 (except for bearing eye 63 of intermediary element 44). Consequently, the rack 60 and the tooth section at 64 are in the plane of the second intermediary element 44. This allows all connecting elements 30 to be constructed identically (that is, the tooth segments of each intermediary element lie in the same plane as the pinions 39 of connecting elements 30). The dashed lines of FIG. 6 clearly show that the rack 60 is stamped from the plane of the H-bar 31**. That is, the dashed lines represent the stamping has not been done using sharp edges.

FIG. 6 and FIG. 7 clearly show a stamped region 80 which extends across the entire width of the web 53. However, FIG. 8 shows a stamped portion or curved notch stamp portion 81 which does not extend across the entire width of the web 53. Thus, according to FIG. 8, it is sufficient if the stamping in the region of rack 60 is smaller, because there is sufficient space to accept the off-set bearing eye 63. From the above, it is clear to the skilled artisan that no arch-shaped stamping or curved notch portion 81 in the region of rack 60 is necessary in order to insure the rotatability of the second intermediary element 44. Thus, either a stamped portion 80 or 81 will result in a smooth operation of the device. That is, the intermediary elements 44 and 45 cooperate as long as portions of the two elements lie in different planes as described in detail above.

Spacers 69 and 70 are located between both the short brackets 5 and 10 and the long brackets 8 and 12, the spacers preferably comprising plastic rings. Another spacer 71, expediently of the same shape, is also provided on one side. All three spacers may be of plastic and, in particular, may be held together by a connecting web to facilitate installation. The long brackets of the one base part 4 are staggered with respect to those of the other base part. The same applies to the short brackets. The short and the long brackets of each base part lie on one and the same or in three planes. Consequently, in FIG. 3 for instance, the outer or side spacer 71 is disposed above the upper long bracket 8 while the corresponding spacer of the other base part 4 is located below the lower long bracket. Again, the situation is analogous for the short brackets. The fitting is constructed symmetric to the miter plane 3. Consequently, the embodiment example possesses six identical short brackets and six identical long brackets. The base parts and all components fastened thereto or retained therein are also identical. This contributes to reducing the production costs.

The drill patterns on the door and on the wall member are identical. When the door is open, almost nothing protrudes inwardly, rather, the brackets run in extension of the door. When the door is closed, the hinge requires relatively little inside space. Regardless of the longitudinal and transverse adjustments, the same closing angle is maintained at all times.

While a specific embodiment of the invention has been shown and described in detail to illustrate the application of the principals of the invention, it will be understood that the invention may be embodied otherwise without departing from such principles.

What is claimed is:

1. A hinge for hinging a door to a wall member, comprising a first base part for connection to the door, a second base part for connection to the wall member, a first long bracket pivotably connected to said first base part, a first short bracket pivotably connected to said first base part at a location spaced laterally from the connection of said first long bracket, a second long bracket pivotably connected to said second base part and a second short bracket pivotably connected to said second base part at a location spaced laterally from the connection of said second long bracket, said first and second long brackets being pivotably connected to each other near centers thereof, said first long bracket being pivotably connected to said second short bracket and said second long bracket being pivotably connected to said first short bracket, said first base part and said second base part each including an outer housing adapted to be fixed to the door in the case of said first base part and the wall member in the case of the second base part, an inner housing mounted for movement in two approximately perpendicular directions in said outer housing and adjustment means for adjusting the relative position in the two approximately perpendicular directions of said inner housing in said outer housing.

2. A hinge according to claim 1, wherein each of said first and second long brackets has an effective length which is about twice the effective length of each of said first and second short brackets respectively.

3. A hinge according to claim 1, wherein each long bracket has a first articulation point pivotably connected to its respective base part, a second articulation point pivotably connected to the other long bracket and a third articulation point pivotably connected to one of said short brackets, said first, second and third articulation points forming an angle of about 160° with each other.

4. A hinge according to claim 2, wherein each long bracket has a first articulation point pivotably connected to its respective base part, a second articulation point pivotably connected to the other long bracket and a third articulation point pivotably connected to one of said short brackets, said first, second and third articulation points forming an angle of about 160° with each other.

5. A hinge according to claim 2, wherein each long bracket includes a longer lever arm connected between its respective base part and the other long bracket, and a shorter lever arm connected between the other long bracket and one of said short brackets, said shorter and longer lever arms having a length ratio of approximately 1:1.15.

6. A hinge according to claim 4, wherein each long bracket includes a longer lever arm connected between its respective base part and the other long bracket, and a shorter lever arm connected between the other long bracket and one of said short brackets, said shorter and longer lever arms having a length ratio of approximately 1:1.15.

7. A hinge according to claim 1, wherein articulation points between said long and short brackets and their respective base parts, between said long bracket and the other long bracket and between said short bracket and the other long bracket form the corners of an approximate parallelogram in all relative positions between said base parts.

8. A hinge according to claim 6, wherein articulation points between said long and short brackets and their respective base parts, between said long bracket and the other long bracket and between said short bracket and the other long bracket form the corners of an approximate parallelogram in all relative positions between said base parts.

9. A hinge according to claim 1, wherein said outer housing comprises an essentially pot-shaped mounting part having a rim and a mounting plate connected to and extending outwardly from said rim, said mounting part having a 45° bevel surface, said hinge having a closed position with said bevelled surfaces of said outer housings extending adjacent and parallel to each other.

10. A hinge according to claim 1, wherein each inner housing has a pot-shaped mounting part with a rim and a mounting plane connected to and extending outwardly from said rim of said inner housing, each inner housing having a 45 bevel surface lying substantially parallel to said bevel surface of said outer housing in which said inner housing is disposed, the door and wall member having engageable bevelled edges extending along a miter plane, said bevel surfaces of said inner and outer housings lying on said miter plane with said hinge in its closed position.

11. A hinge according to claim 1, wherein said mounting plate of each outer housing includes a depression for receiving said mounting plate of one of said inner housings, and two spaced apart connecting elements connecting each outer housing to its respective inner housing, each connecting element having an axis extending transversely to said two approximately perpendicular directions.

12. A hinge according to claim 9, wherein said pot shaped mounting part for each outer housing includes a pot shaped portion having a diameter, said pot-shaped mounting part of each outer housing being adapted for reception into a single bore in one of the door and wall members, said mounting plate of each outer housing having a width which is approximately on half the length of said pot shaped portion diameter of said outer housing pot shaped mounting part, said bevelled surface of said outer housing mounting part extending in a remaining half of the diameter of said mounting part.

13. A hinge according to claim 1, wherein said adjustment means comprises first and second turning members rotatably mounted to each inner housing, and first and second intermediate members connected between each inner and outer housing, each intermediate member being operatively connected to one of said first and second turning members for converting rotation of each turning member into relative movement between said inner and outer housings in one of said two approximately perpendicular directions.

14. A hinge according to claim 13, wherein said adjustment means comprises first and second turning members rotatably mounted to each inner housing, said first and second intermediate members connected between each inner and outer housing, each intermediate member being operatively connected to one of said first and second turning members for converting rotation of each turning member into relative movement between said inner and outer housings in one of said two approximately perpendicular directions.

15. A hinge according to claim 14, wherein each turning member includes a pinion, each intermediate member having a toothed segment engaged with one of said pinions.

16. A hinge according to claim 15, wherein said first intermediate member of each inner housing is mounted for sliding movement with respect to said inner housing and in one of said perpendicular directions, said first intermediate member having a block-shaped attachment, said outer housing having guide means for receiving said block-shaped attachment to transmit rotation of said first turning member into relative movement in the first perpendicular direction between said inner and outer housings.

17. A hinge according to claim 16, wherein said first intermediate member is substantially H-shaped, said H-shaped intermediate member having a pair of H-shaped legs, and a web connecting said H-shaped legs together, said inner housing having a recessed guideway for receiving said H-shaped legs for movement in the one perpendicular direction, said H-shaped legs being approximately flush with said guide means, said inner housing having a pot bottom in which said guide means is defined and including two stop edges on opposite sides of said web for defining movement of said web in said one perpendicular direction, said toothed segment of said first intermediate member being defined on an inside of one of said H-shaped legs facing the other of said H-shaped legs.

18. A hinge according to claim 17, herein said block-shaped attachment is connected to said web and is located in the same plane as said tooth engagement of said first intermediate member.

19. A hinge according to claim 18, wherein said second intermediate member is pivotably mounted to said outer housing at one end of said second intermediate member, said tooth segment of said second intermediate member being provided at an opposite end of said second intermediate member, said second intermediate member having a sliding pin intermediate its length, said inner housing having guide means for receiving said sliding pin for transmitting pivoting of said second intermediate member into relative movement in the other of said perpendicular directions between said inner and outer housings.

20. A hinge according to claim 14, wherein said second intermediate member lies in the plane containing said tooth segment and said attachment of said first intermediate member, said attachment comprising two mutually spaced parts, said second intermediate member extending between said spaced part.

21. A hinge according to claim 20, wherein said second intermediate member includes a bearing lug for rotatably mounting said second intermediate member to said outer housing, said bearing lug lying in a plane containing said first intermediate member and being offset from the remainder of said second intermediate member.

22. A hinge according to claim 21, wherein said bearing lug of said second intermediate member is mounted for rotation on said first turning member, said bearing lug being at an end of said second intermediate member opposite from said tooth segment of said second intermediate member which is engaged with said pinion of said second turning member.

23. A hinge according to claim 15, wherein each turning member includes a bearing shaft, said pinion being formed as a single part with said bearing shaft, said bearing shaft having a disc-shaped head adjacent its pinion, each turning member also including a tubular actuating member connected to said bearing shaft, said pot-shaped mounting part of said outer housing having a bottom with an opening therethrough, said bearing shaft extending through said opening with said head engaged against an outside of said mounting part, said inner housing having an opening therein bounded by a shoulder, said actuating member being disposed in said opening and engaged against said shoulder.

24. A hinge according to claim 23, wherein said mounting part of said outer housing has a recess around said opening therethrough, said head of said bearing shaft being engaged in said recess.

25. A hinge according to claim 23, wherein said opening in said inner housing is defined in an extended part of said inner housing extending around said actuating member.

26. A hinge according to claim 23, wherein said bearing shaft is press-fit into said actuating member for connecting said bearing shaft to said actuating member.

27. A hinge according to claim 23, wherein said actuating member has an outer face with at least one actuating slot therein adapted for receiving a screw driver blade.

28. A hinge according to claim 1, wherein said long brackets are connected together near their centers by a connecting pin, said long and short brackets being symmetrical with respect to a plan extending through said pin.

29. A hinge according to claim 1, including a plurality of first long brackets and a plurality of first short brackets connected to said first base part, a plurality of second long brackets and a plurality of second short brackets connected to said second base part, each of said separate first and second long and short brackets lying in separate parallel planes, and a plurality of annular spacers between each of said first and second long and short brackets at the point where they connect with said first and second base parts, said annular spacers each being made of plastic.

* * * * *